US006857503B2

(12) United States Patent
Simpson et al.

(10) Patent No.: US 6,857,503 B2
(45) Date of Patent: Feb. 22, 2005

(54) CONVERTIBLE LADDER

(75) Inventors: Dennis Simpson, Minnetonka, MN (US); Ryan McMunn, Edina, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 0 days.

(21) Appl. No.: 10/360,540

(22) Filed: Feb. 6, 2003

(65) Prior Publication Data

US 2003/0217888 A1 Nov. 27, 2003

Related U.S. Application Data

(63) Continuation-in-part of application No. 10/152,126, filed on May 16, 2002, which is a continuation-in-part of application No. 10/147,115, filed on May 16, 2002.

(60) Provisional application No. 60/358,788, filed on Feb. 22, 2002, and provisional application No. 60/355,026, filed on Feb. 7, 2002.

(51) Int. Cl.[7] ..... E06C 1/00

(52) U.S. Cl. ..... 182/22; 182/178.3; 182/27

(58) Field of Search ..... 182/178.2, 178.6, 182/27, 163, 22, 23, 180.1, 152, 151, 194

(56) References Cited

U.S. PATENT DOCUMENTS

| | | | | | |
|---|---|---|---|---|---|
| 317,024 | A | * | 5/1885 | Schumann | 182/178.3 |
| 445,453 | A | * | 1/1891 | Nowland | |
| 1,942,210 | A | * | 1/1934 | Harting | 182/22 |
| 3,476,211 | A | * | 11/1969 | Cormier | 182/22 |
| 3,481,026 | A | * | 12/1969 | Lindesmith et al. | 29/516 |
| 3,692,143 | A | | 9/1972 | Kummerlin et al. | 182/24 |
| 3,811,151 | A | | 5/1974 | Kuemmerlin | 16/144 |

(List continued on next page.)

OTHER PUBLICATIONS

Wing Enterprise, Inc., Little Giant, Aug. 1990.*
Brochure, "Step Stools ● Ladders 2001," Cosco, Inc., pp. 1–18 (2001).
Brochure re: The Little Giant, not dated.
Brochure, "Ladders," Tricam Industries, pp. 1–4, not dated.
Fact Sheet, "Prostep Multi–Folding Ladder, Type I," Tricam Industries, No. 001–1 (3/94).
Brochure, "Jaws / Climbing systems for professionals and do–it–yourselfers," Featherlite Industries (1996).
Spec sheet, "Fiberglass VersaLadder™," Versa Products Inc., not dated.
Brochure, "VersaLadder™, The Original, Amazing, Multi–purpose, Heavy–duty, Folding Ladder!" Versa Products Inc., not dated.
Brochure, "VersaLadder™" (6/93).
Brochure, "Unless your ladder looks like this . . . and does this . . . " Wing Enterprises, Inc., not dated.
Operating and Safety Instructions, "Little Giant Ladder Systems, Type IA," Wing Enterprises, Inc. (8/90).
Brochure, "Ladders," Keller Ladders, Inc. (08/98).
Brochure, "Columbia & Blue Ribbon 1999 Ladders," Columbia Ladders/Blue Ribbon Ladders.
Keller™ 2000/2001 Product Catalog, page 8.
Brochure, Krause (1997).
Brochure, "The Little Giant Ladder System® Fiberglass," Wing Enterprises, date obscured.

*Primary Examiner*—Alvin Chin-Shue
(74) *Attorney, Agent, or Firm*—Patterson, Thuente, Skaar & Christensen P.A.; Michael A. Bondi

(57) ABSTRACT

A ladder having a first ladder section, a second ladder section, an adjustable hinge mechanism, an engagement indicator and a static hinge mechanism. The adjustable hinge mechanism is mounted with respect to the first ladder and the second ladder so that the adjustable hinge mechanism is moveable between an engaged position and a disengaged position. The static hinge mechanism enables the first and second ladder sections to be maintained in a stationary position with respect to each other.

5 Claims, 13 Drawing Sheets

U.S. PATENT DOCUMENTS

| | | | | | |
|---|---|---|---|---|---|
| 4,031,981 | A | | 6/1977 | Spencer | 182/153 |
| 4,060,150 | A | * | 11/1977 | Hughes | 182/151 |
| 4,061,203 | A | | 12/1977 | Spencer et al. | 182/214 |
| D248,777 | S | | 8/1978 | Spencer et al. | D25/68 |
| RE30,020 | E | | 6/1979 | Spencer et al. | 182/153 |
| 4,182,431 | A | | 1/1980 | Wing | 182/23 |
| 4,210,224 | A | | 7/1980 | Kummerlin et al. | 182/207 |
| 4,216,844 | A | | 8/1980 | Klafs | 182/104 |
| 4,298,093 | A | | 11/1981 | Wing | 182/153 |
| 4,371,055 | A | | 2/1983 | Ashton et al. | 182/46 |
| 4,376,470 | A | | 3/1983 | Ashton | 182/23 |
| 4,407,045 | A | | 10/1983 | Boothe | 16/327 |
| 4,469,193 | A | * | 9/1984 | Rumsey, Jr. | 182/22 |
| 4,470,045 | A | | 9/1984 | Anderson | 340/783 |
| 4,483,415 | A | * | 11/1984 | Disston et al. | 182/22 |
| 4,502,566 | A | | 3/1985 | Wing | 182/214 |
| 4,566,150 | A | | 1/1986 | Boothe | 16/332 |
| 4,577,986 | A | | 3/1986 | Wang | 403/93 |
| 4,602,889 | A | | 7/1986 | Mu-Shan | 403/91 |
| 4,666,327 | A | | 5/1987 | Su | 403/24 |
| 4,666,328 | A | | 5/1987 | Ryu | 403/92 |
| 4,697,305 | A | | 10/1987 | Boothe | 16/329 |
| 4,770,559 | A | | 9/1988 | Yoo | 403/93 |
| 4,773,503 | A | | 9/1988 | Purkapile | 182/22 |
| 4,824,278 | A | | 4/1989 | Chang | 403/93 |
| D309,502 | S | | 7/1990 | Wing et al. | D25/68 |
| 4,951,780 | A | * | 8/1990 | Kim | 182/27 |
| 4,974,701 | A | | 12/1990 | Parise | 182/194 |
| 5,026,198 | A | | 6/1991 | Lin | 403/27 |
| 5,074,377 | A | | 12/1991 | Krause | 182/167 |
| 5,163,532 | A | | 11/1992 | McCarty | 182/163 |
| 5,228,535 | A | | 7/1993 | McCarty | 182/163 |
| 5,353,892 | A | | 10/1994 | Lu | 182/163 |
| 5,487,207 | A | | 1/1996 | Rey | 16/330 |
| 5,620,272 | A | | 4/1997 | Sheng | 403/96 |
| 5,775,460 | A | | 7/1998 | Stone | 182/22 |
| 5,954,157 | A | | 9/1999 | Grimes et al. | 182/163 |
| 5,992,566 | A | | 11/1999 | Yeh | 182/163 |

* cited by examiner

140

140

160

CONVERTIBLE LADDER

REFERENCE TO RELATED APPLICATIONS

The present application is a continuation-in-part of, and claims priority to, U.S. patent application Ser. No. 10/152,126, filed May 16, 2002, U.S. patent application Ser. No. 10/147,115, filed May 16, 2002, U.S. Provisional Application No. 60/358,788, filed Feb. 22, 2002, and U.S. Provisional Application No. 60/355,026, filed Feb. 7, 2002, which are hereby incorporated by reference in their entirety.

FIELD OF THE INVENTION

The present invention relates generally to a ladder. More particularly, the present invention relates to a convertible ladder that is positionable in a variety of configurations.

BACKGROUND OF THE INVENTION

For some time it has been known that constructing ladders with two sections that are slidably mounted with respect to each other enables the overall length of the extension ladder to be varied depending upon the desired use of the extension ladder. This feature is particularly useful for transporting the ladder to a desired use location.

Conventional extension ladders do not have the ability to stand up without being leaned against another object. In certain circumstances it is not possible to lean the extension ladder against other objects. To overcome this limitation, Kummerlin et al., U.S. Pat. No. 3,692,143, pivotally attaches two extension ladders together. This ladder retained the benefits of being able to adjust the height of the ladder while adding the benefit that the ladder could remain erect without leaning against other objects.

Boothe, U.S. Pat. Nos. 4,407,045 and 4,566,150, are both directed to a hinge for an articulating ladder. The hinge includes two hinge plates that are pivotally attached with a central hub. Pivoting of the hinge plates is controlled with a locking handle that extends through apertures in the hinge plates. The locking handle is biased to a locking position where the legs on the locking handle extend into the hinge plate apertures.

SUMMARY OF THE INVENTION

The present invention is a convertible ladder that includes a first ladder portion, a second ladder portion and an adjustable hinge mechanism. The first ladder portion and the second ladder portion each include a first section and a second section.

The first and second sections of the first ladder portion are slidably attached to each other. The first and second sections of the second ladder portion are slidably attached to each other. The first sections of the first and second ladder portions are pivotally attached to each other.

The present invention also includes two alternative fixed hinge mechanisms and an alternative adjustable hinge mechanism that are attachable to the second sections of the first and second ladder portions to maintain the second sections in an erect or linear position with respect to each other.

DETAILED DESCRIPTION OF THE PREFERRED EMBODIMENTS

Figure 2:
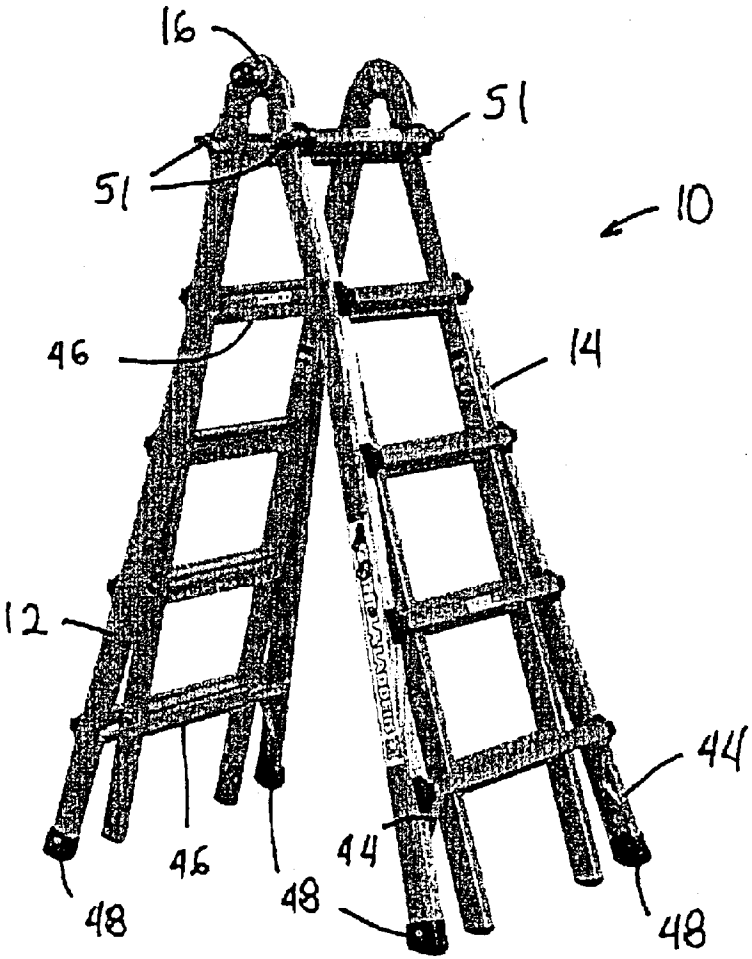
FIG. 2 is a photograph of the convertible ladder in a second orientation.

The present invention is a convertible ladder, as most clearly illustrated at 10 in FIGS. 1–4. The convertible ladder 10 includes a first ladder portion 12 and a second ladder portion 14 that are interconnected with an adjustable hinge mechanism 16.

The convertible ladder 10 is convertible between four different configurations. In a first configuration, the convertible ladder 10 is an extension ladder, as most clearly illustrated in FIG. 1. In a second configuration, the convertible ladder 10 is an upright standing, 2-sided step ladder, as most clearly illustrated in FIG. 2. In a third configuration, the convertible ladder 10 separates into two ladder portions 10*a*, 10*b* that may be used independently or with a scaffold 20, as most clearly illustrated in FIG. 3. In a fourth configuration, the convertible ladder 10 is adjusted so that the first ladder portion 12 and the second ladder portion 14 have different lengths to facilitate using the convertible ladder on uneven surfaces such as stairs 22, as most clearly illustrated in FIG. 4.

As a result of the various configurations in which the convertible ladder 10 may be positioned, the convertible ladder 10 of the present invention takes the place of several different prior art ladders. The convertible ladder 10 thereby reduces the number of ladders that a person must own to do a variety of tasks.

Figure 1:
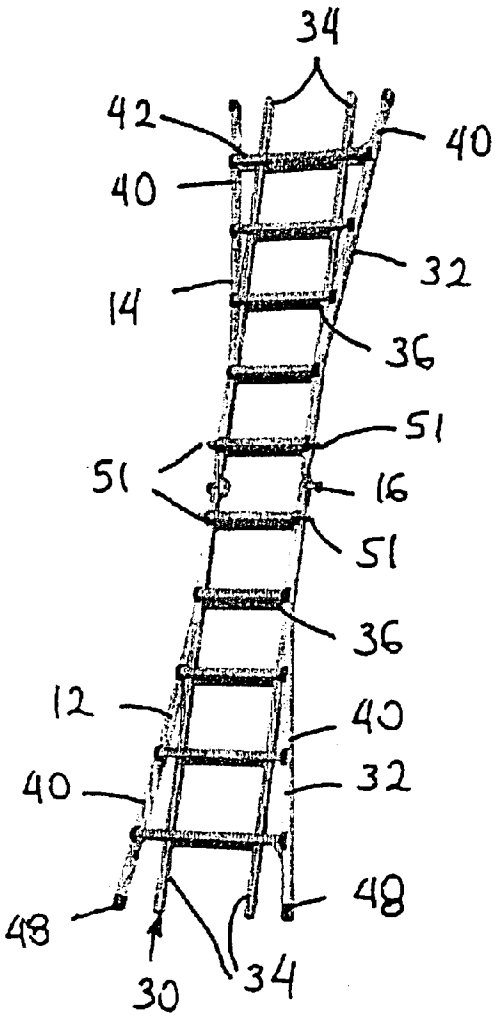
FIG. 1 is a photograph of a convertible ladder of the present invention in a first orientation.
Figure 4:
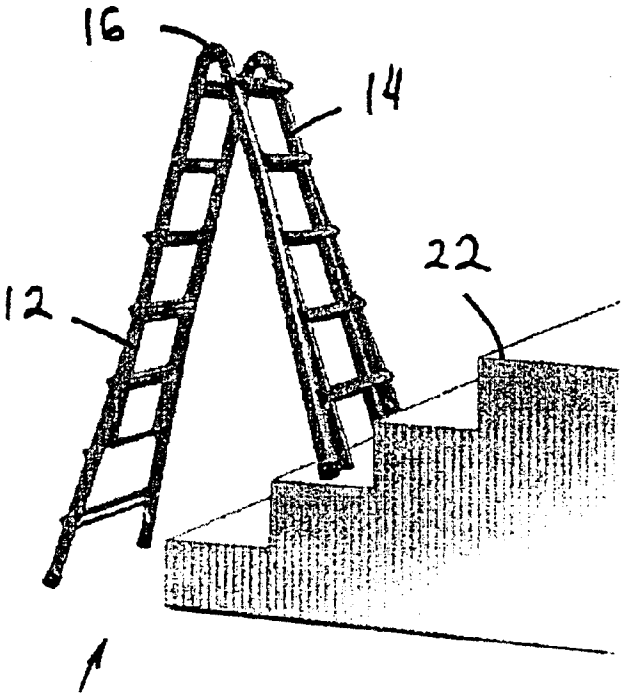
FIG. 4 is a photograph of the convertible ladder in a fourth orientation.
Figure 3:
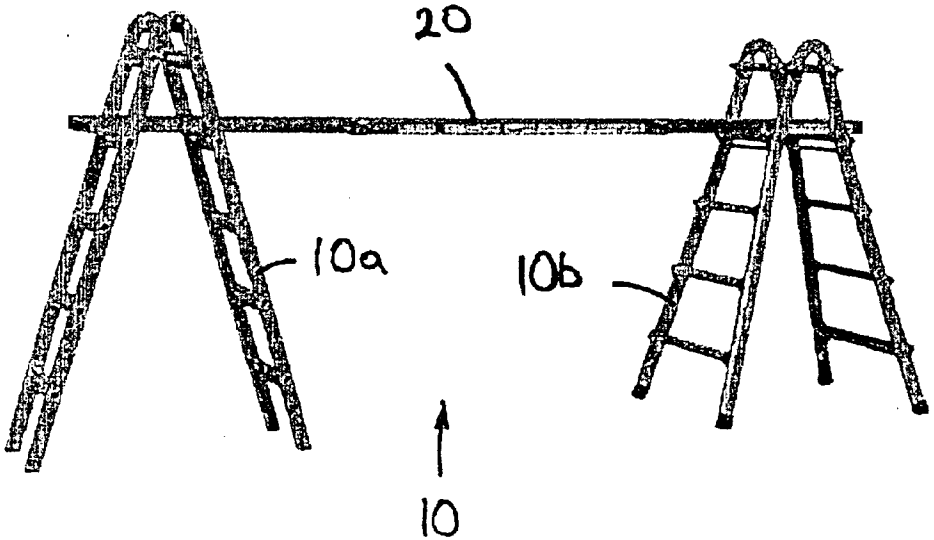
FIG. 3 is a photograph of the convertible ladder in a third orientation.

The first ladder portion 12 and the second ladder portion 14 each include a first section 30 and a second section 32 that are slidably attached together, as most clearly illustrated in FIG. 1. The first section 30 includes a pair of first side rails 34 and a plurality of first rungs 36 that are mounted to extend between the first side rails 34 at selected intervals. The first side rails 34 preferably have a rectangularly shaped configuration. A person of ordinary skill in the art will appreciate that the size of the first side rails 34 and the first rungs 36 is selected based upon the intended use of the convertible ladder 10.

The second section 32 includes a pair of second side rails 40 and a plurality of second rungs 42 that are mounted to extend between the second side rails 40 at selected intervals. The second side rails 40 preferably have a C-shaped configuration that permits the first side rails 34 to at least partially seat with the second side rails 40. A person of ordinary skill in the art will appreciate that the size of the second side rails 40 and the second rungs 42 is selected based upon the intended use of the convertible ladder 10.

Figure 5:
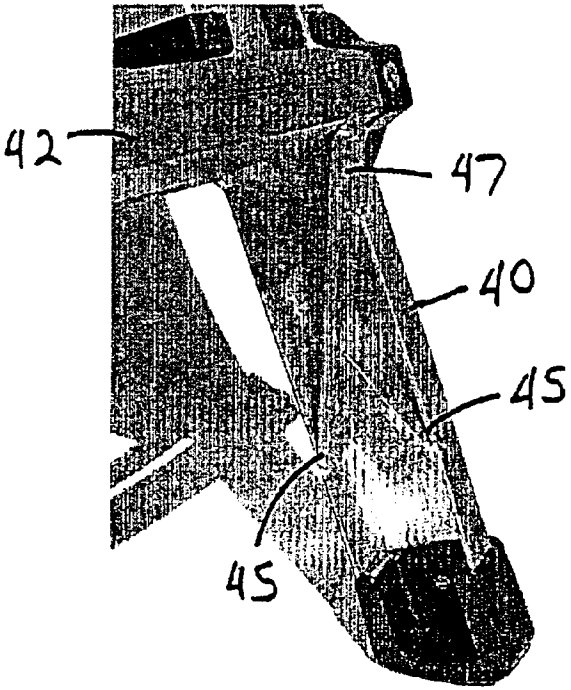
FIG. 5 is an enlarged view of a lower end of the convertible ladder.

The second section 32 also preferably includes a Y-shaped brace 44 proximate a lower end thereof, as illustrated in FIGS. 2 and 5. Lower ends 45 of the brace 44 are attached to the front and back of each C-shaped side rail 40. The upper end 47 of the brace 44 is attached to the lowest rung 42. The brace 44 thereby enhances the ability of the ends of the second sections 32 to resist deformation when forces are applied thereto.

The second section 32 further preferably includes at least one brace 46 that extends between the second side rails 40 opposite the rungs 42, as illustrated in FIG. 2. Preferably one of the braces 46 is located proximate a lower end of the second section 32 and one of the braces 46 is located proximate an upper end of the second section 32. The at least one brace 46 further enhances the structural rigidity of the second section 32.

Proximate lower ends of the second side rails 40, feet 48 are attached thereto, as illustrated in FIGS. 2 and 5. The feet 48 enhance the ability of the convertible ladder 10 to remain in a stationary position. The feet 48 are preferably removably attached to the second side rails 40 with a bolt. The bolt enables the feet 48 to be readily replaced when damaged.

The lower ends of the second side rails 40 are flared apart from each other so that a distance between the second side rails 40 proximate the lower end is greater than or equal to a distance between the second side rails 40 proximate the upper end. Using this configuration enhances the lateral stability of the convertible ladder 10.

Figure 7:
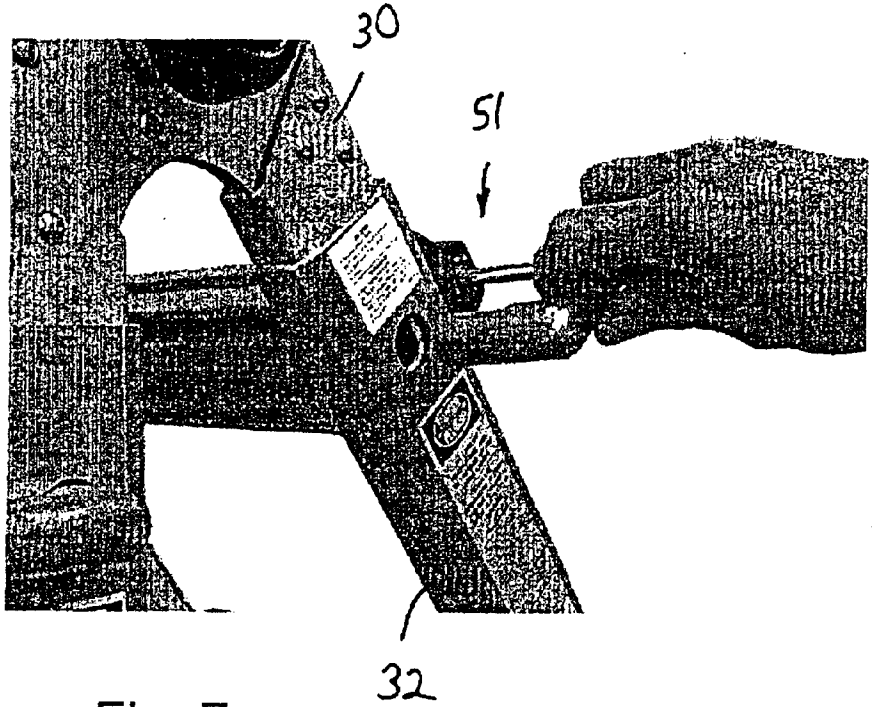
FIG. 7 is a photograph of a locking mechanism of the convertible ladder in a disengaged orientation.
Figure 6:
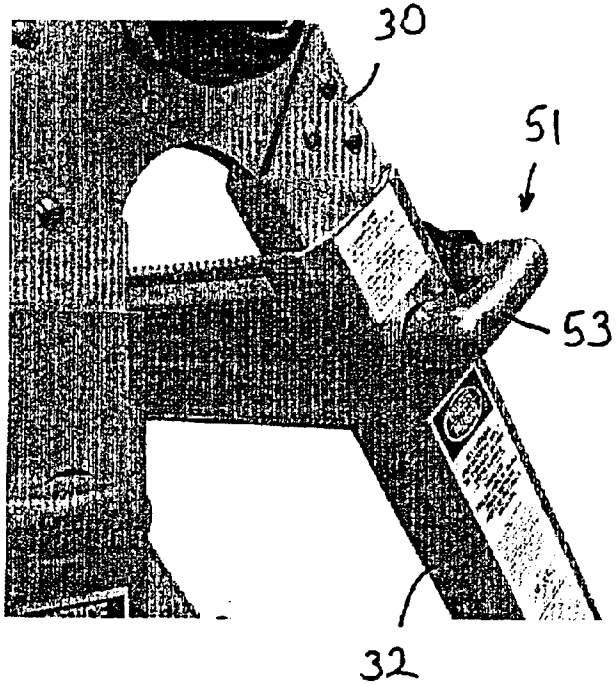
FIG. 6 is a photograph of the locking mechanism in an engaged position.

The second sections 32 each have a pair of locking mechanisms 51. The locking mechanisms 51 are attached to the second side rails 40 proximate an upper end thereof. The locking mechanism 51 preferably includes a lock handle 53. The lock handle 53 is movable between in an engaged position and a disengaged position. The lock handle 53 is preferably biased to the engaged position. When in the engaged position, the lock handle 53 engages the first section 30 and thereby maintains the first section 30 in a fixed position with respect to the second section 32, as illustrated in FIG. 6. When in the disengaged position, the lock handle 53 permits the first section 30 to slide with respect to the second section 32, as illustrated in FIG. 7.

The adjustable hinge mechanism 16 includes a handle 50, a first hinge plate 52 and a second hinge plate 54, as most clearly illustrated in FIGS. 8–11. The first hinge plate 52 is pivotally mounted with respect to the second hinge plate 54.

The first hinge plate 52 and the second hinge plate 54 each include a pivot aperture 56 formed therein. The pivot apertures 56 are aligned when the first hinge plate 52 is pivotally attached to the second hinge plate 54.

Figure 11:
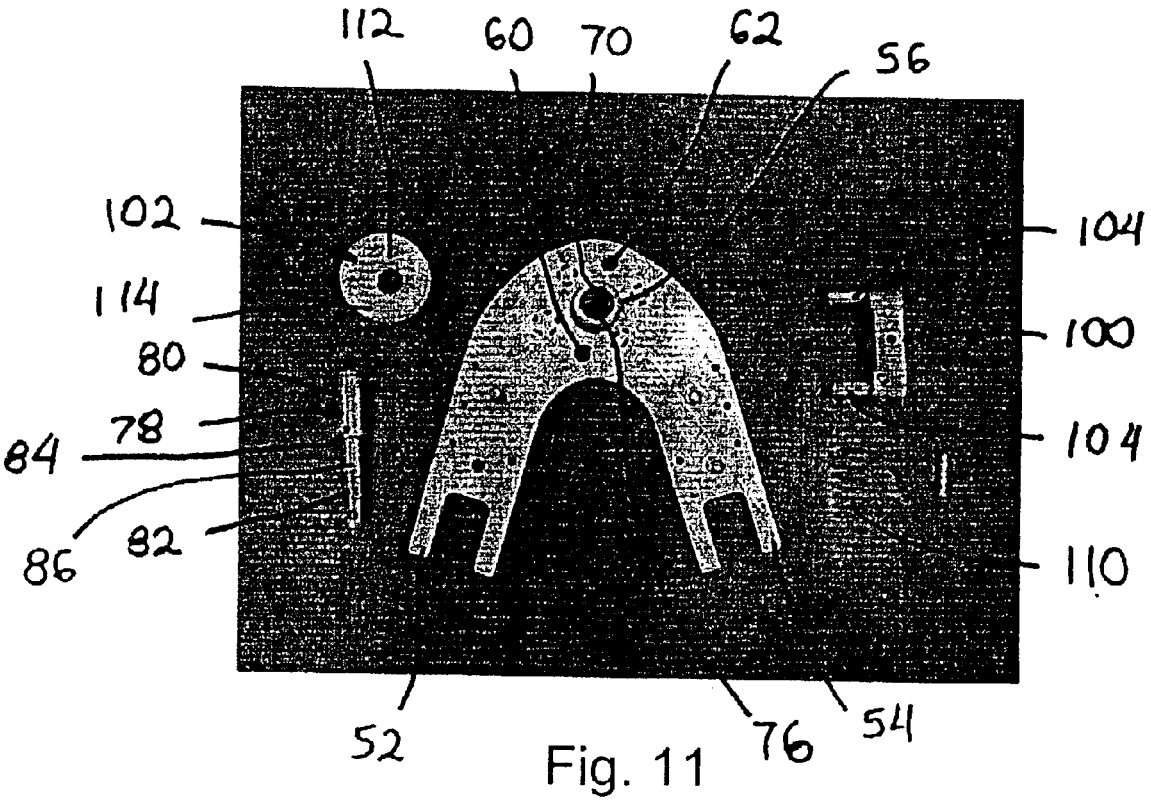
FIG. 11 is a top view of the adjustable hinge mechanism in an unassembled configuration.

The first hinge plate 52 has a pair of first positioning apertures 60 formed therein, as most clearly illustrated in FIG. 11. The first positioning apertures 60 are located on opposite sides of the pivot aperture 56.

The second hinge plate 54 preferably has three pair of second positioning apertures 62 formed therein (two pairs are shown in phantom and one pair is aligned with the first positioning apertures 60). The second positioning apertures 62 are located on opposite sides of the pivot aperture 56 so that each pair of second positioning apertures 62 may be selectively aligned with the first positioning apertures 60.

Figure 12:
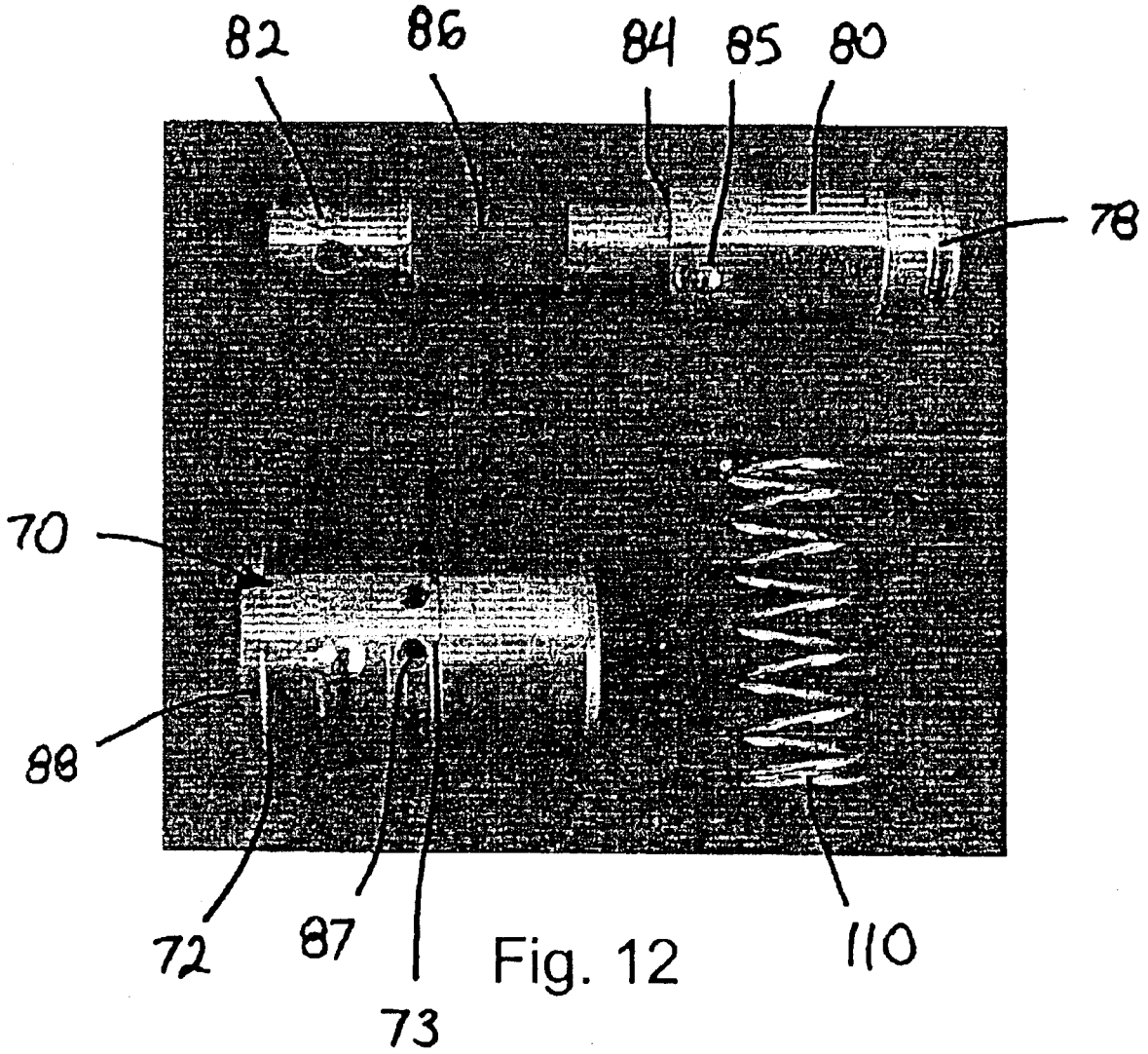
FIG. 12 is a bottom view of the adjustable hinge mechanism in the unassembled configuration.

A hub 70 extends through the pivot apertures 56 to pivotally attach the first hinge plate 52 to the second hinge plate 54, as illustrated in FIGS. 11 and 12. Proximate a first end of the hub 70 an outwardly extending flange 72 is provided. A channel 73 is provided at an intermediate location on the hub 70. A locking clip 74 seats in the channel 73 to retain the first hinge portion 52 and the second hinge portion 54 on the hub 70.

The hub 70 has a bore 76 extending therethrough. The bore 76 is adapted to receive a hinge shaft 78. The hinge shaft 78 has a first shaft section 80 and a second shaft section 82 that are substantially adjacent to each other. The second shaft section 82 has a diameter that is smaller than the first shaft section 80 so as to define a shoulder 84.

The first shaft section 80 has at least one recess 85 formed therein that is adapted to receive an outwardly biased ball bearing (not shown). An additional recess (not shown) may be formed on an opposite side of the first shaft section 80 to receive another outwardly biased ball bearing. The ball bearing is adapted to engage a corresponding recess 87 formed in the hub 70.

Seating of the ball bearing in the recess 87 maintains the adjustable hinge mechanism 16 in the disengaged position so that the hinge plates 52, 54 may be pivoted with respect to each other. Once the hinge plates 52, 54 are positioned at a desired orientation, a modest force on the handle 50 causes the adjustable hinge mechanism 16 to return to the engaged position.

A diameter of the hub bore 76 is approximately the same as the diameter of the first shaft section 80. The hub 70 also preferably includes an end plate 88 proximate the second end. The end plate 88 has an aperture formed therein. A diameter of the end plate aperture is approximately the same as a diameter of the second shaft section 82.

A safety sleeve 86 extends at least a portion of the second shaft section 82. The safety sleeve 86 is preferably fabricated from a material with a color that contrasts from a color of the other portions of the convertible ladder 10 so that the safety sleeve 86 is readily visible when exposed. A person of ordinary skill in the art will appreciate that, as an alternative to placing a safety sleeve 86 over the second shaft section 82, the safety sleeve 86 may be formed by applying paint to the second shaft section 82.

Figure 14:
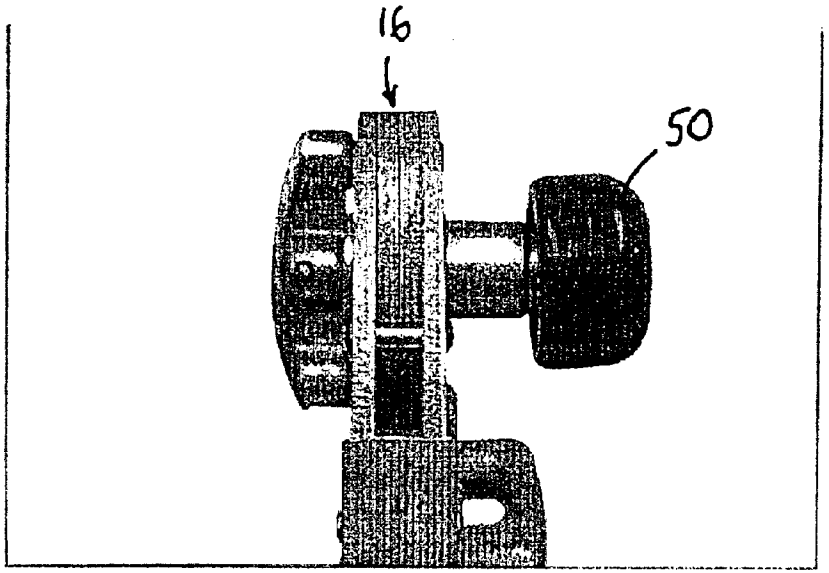
FIG. 14 is a photograph of the adjustable hinge mechanism in an engaged orientation.
Figure 13:
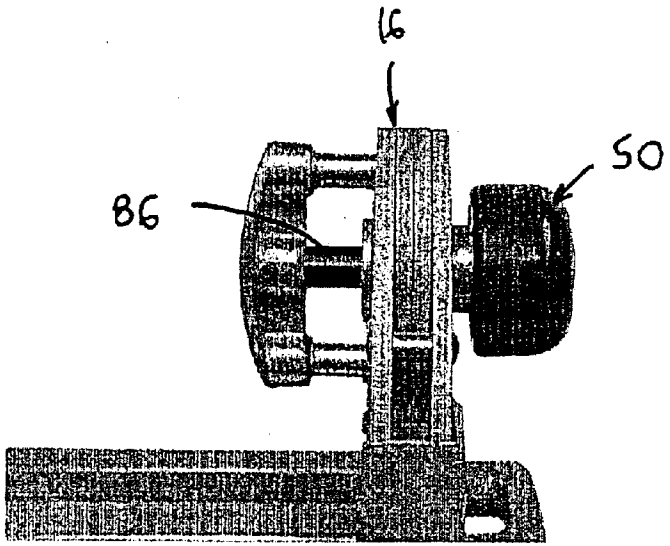
FIG. 13 is a photograph of the adjustable hinge mechanism in a disengaged orientation.

When in the disengaged position, as illustrated in FIG. 13, the safety sleeve 86 is visible on either side of the convertible ladder 10. When in the engaged position, as illustrated in FIG. 14, the safety sleeve 86 is not visible on either side of the convertible ladder 10. The safety sleeve 86 thereby indicates to the person that the person should not step on the convertible ladder 10, as the adjustable hinge mechanism 16 is not in the engaged position.

Figure 8:
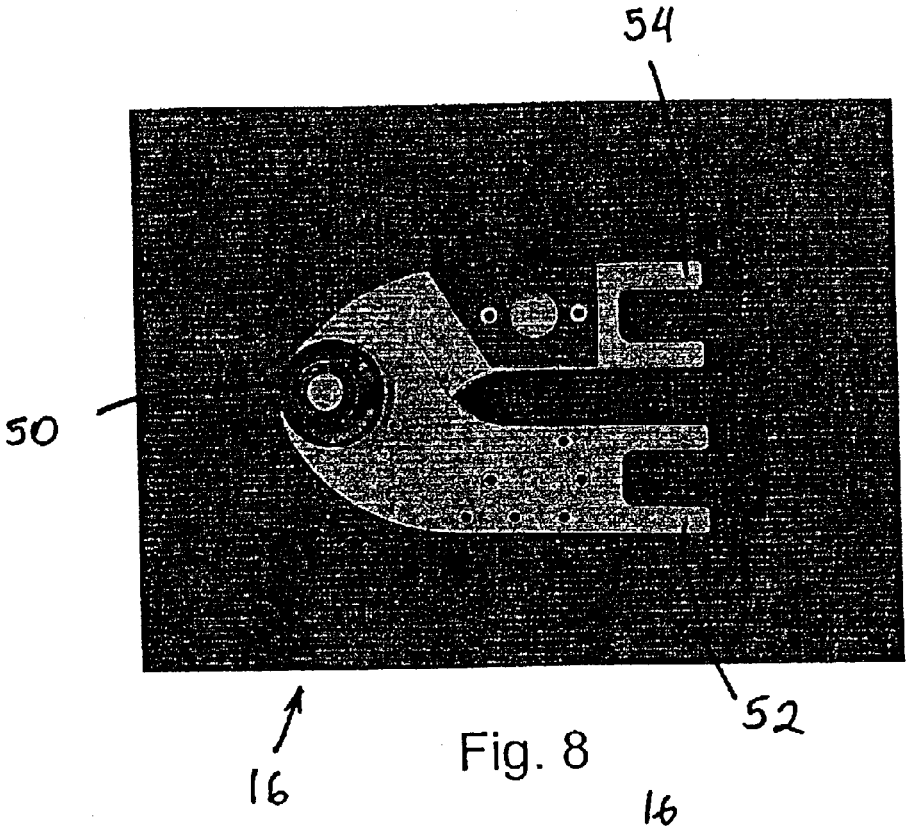
FIG. 8 is a top view of an adjustable hinge mechanism in an assembled configuration.
Figure 9:
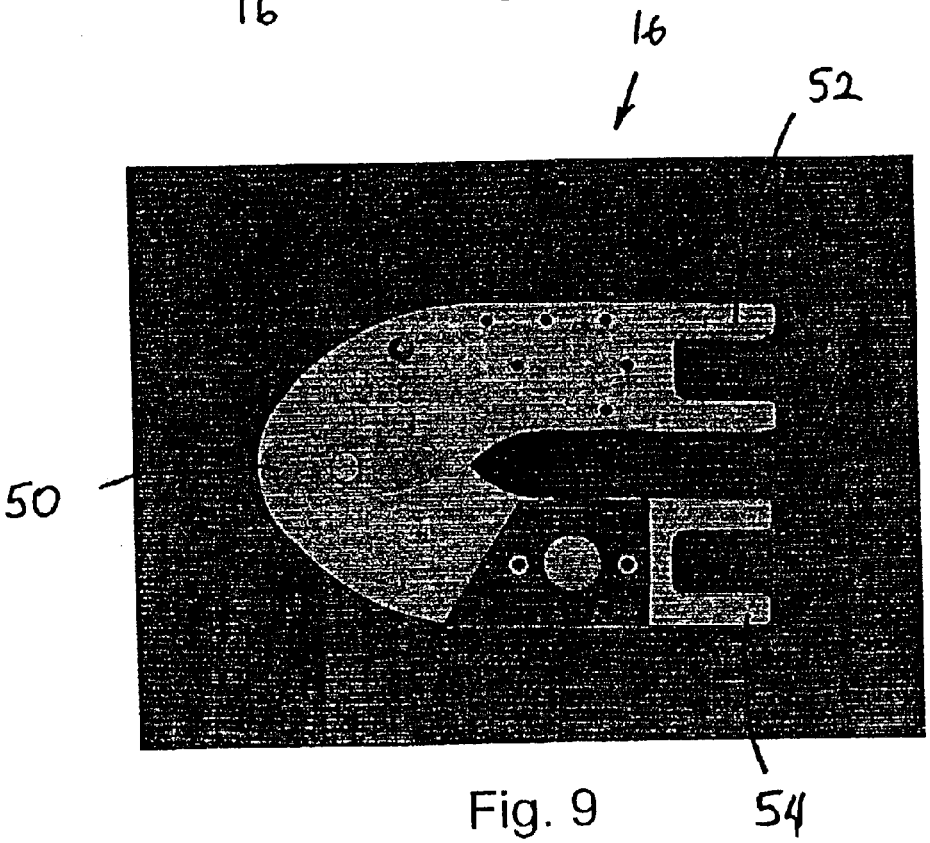
FIG. 9 is a bottom view of the adjustable hinge mechanism in the assembled configuration.
Figure 10:
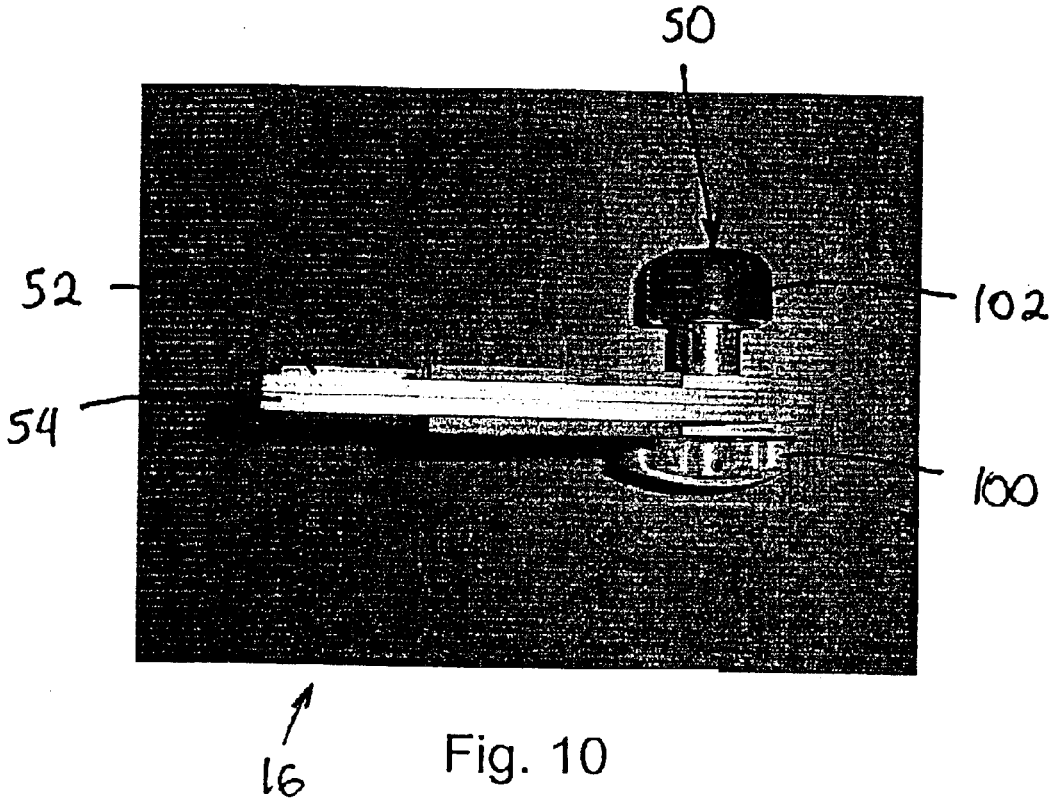
FIG. 10 is a side view of the adjustable hinge mechanism in the assembled configuration.

The handle 50 has a first portion 100 and a second portion 102 that are attached on opposite sides of the hinge shaft 78, as illustrated in FIGS. 8–10. The first portion 100 preferably has a substantially elongated shape with a pair of locking pins 104 extending therefrom. The locking pins 104 are preferably selected with a width that is approximately the same as the diameter of the first positioning apertures 60 and the second positioning apertures 62.

Moving the first portion 100 towards the first hinge plate 52 causes the locking pins 104 to extend through the first positioning apertures 60 and the second positioning apertures 62 to thereby maintain the first hinge plate 52 in a rotational position with respect to the second hinge plate 54.

The adjustable hinge mechanism 16 preferably includes a spring 110 that biases the first portion 100 towards the first hinge plate 52 to maintain the adjustable hinge mechanism 16 in a locked position. Urging the second portion 102 towards the first hinge plate 52 causes the locking pins 104 to be withdrawn from the first positioning apertures 60 and the second positioning apertures 62 to thereby permit the first hinge plate 52 to rotate with respect to the second hinge plate 54.

The second portion 102 preferably has a substantially cylindrical shape that includes a top section 112 and a side section 114 that extends from the top section 112. The top section 112 provides a substantially flat surface that is depressed for urging the adjustable hinge mechanism 16 from the engaged position to the disengaged position. The side section 114 extends towards the first hinge section 52 and thereby reduces the potential for a person's fingers to become pinched between the second portion 102 and the first hinge section 52.

Figure 15:
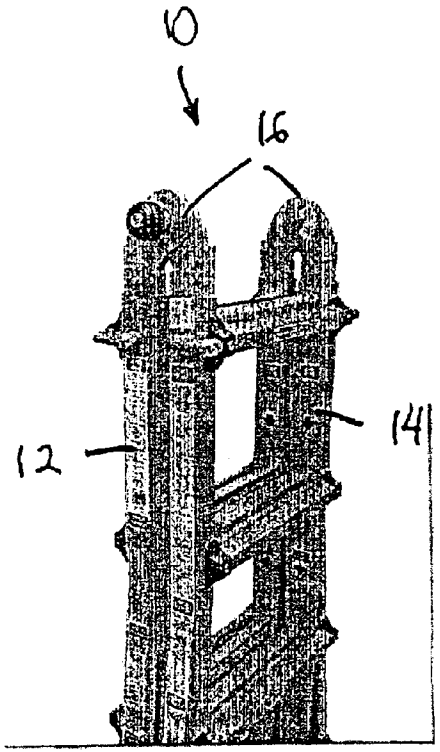
FIG. 15 is a photograph of the adjustable hinge mechanism in a first position.

Using the three pairs of second positioning apertures 62 enables the first hinge plate 52 to be locked at three different angular positions with respect to the second hinge plate 54. In a first orientation of the adjustable hinge mechanism 16, the first ladder portion 12 is positioned adjacent to the second ladder portion 14 for storage or transportation, as most clearly illustrated in FIG. 15.

Figure 17:
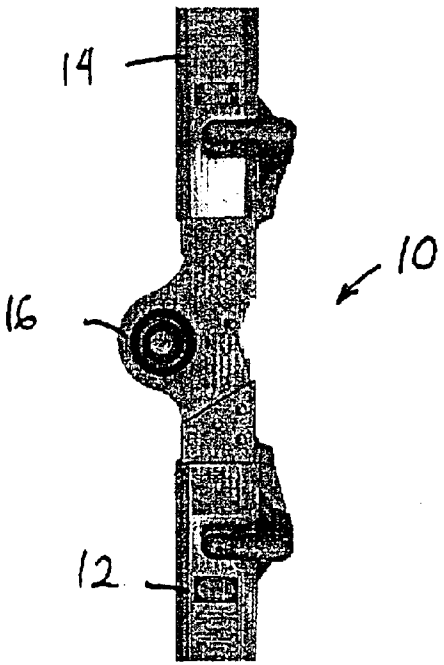
FIG. 17 is a photograph of the adjustable hinge mechanism in a third position.
Figure 16:
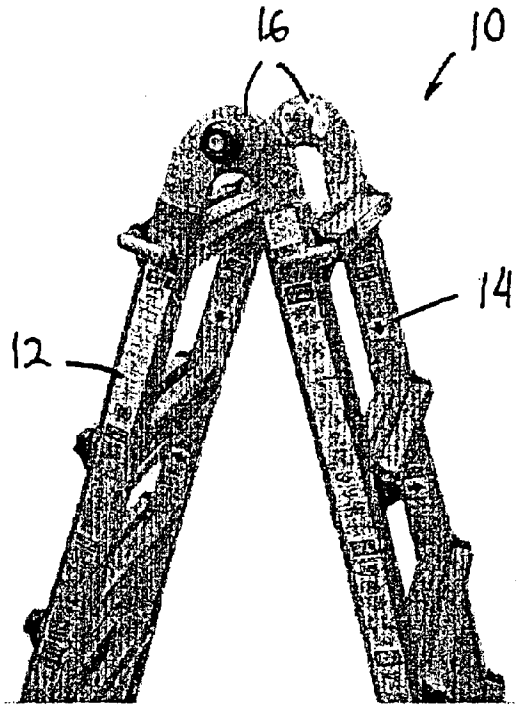
FIG. 16 is photograph of the adjustable hinge mechanism in a second position.

In a second orientation of the adjustable hinge mechanism 16, the first ladder portion 12 is oriented at an angle with respect to the second ladder portion 14 for use as a step ladder, as most clearly illustrated in FIG. 16. In a third orientation of the adjustable hinge mechanism 16, the first ladder portion 12 is parallel to and aligned with the second ladder portion 14 for use as an extension ladder, as most clearly illustrated in FIG. 17. A person of ordinary skill in the art will appreciate that varying the number of second positioning apertures 62 allows the number of angular orientations to be varied.

Figure 18:
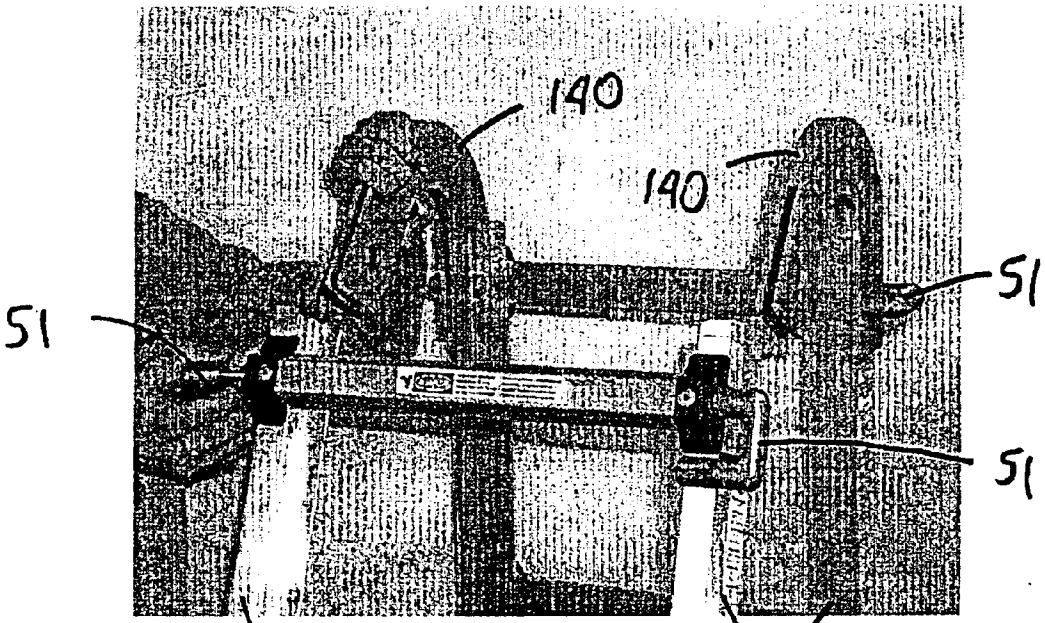
FIG. 18 is a photograph of a static hinge mechanism partially attached to the convertible ladder with the locking mechanism.

Two of the static hinge mechanisms 140 are preferably attached to one of the second sections 32, as illustrated in FIG. 18. Another second section 32 is then aligned with the static hinge mechanism 140 to assemble the erect step ladder.

Figure 19:
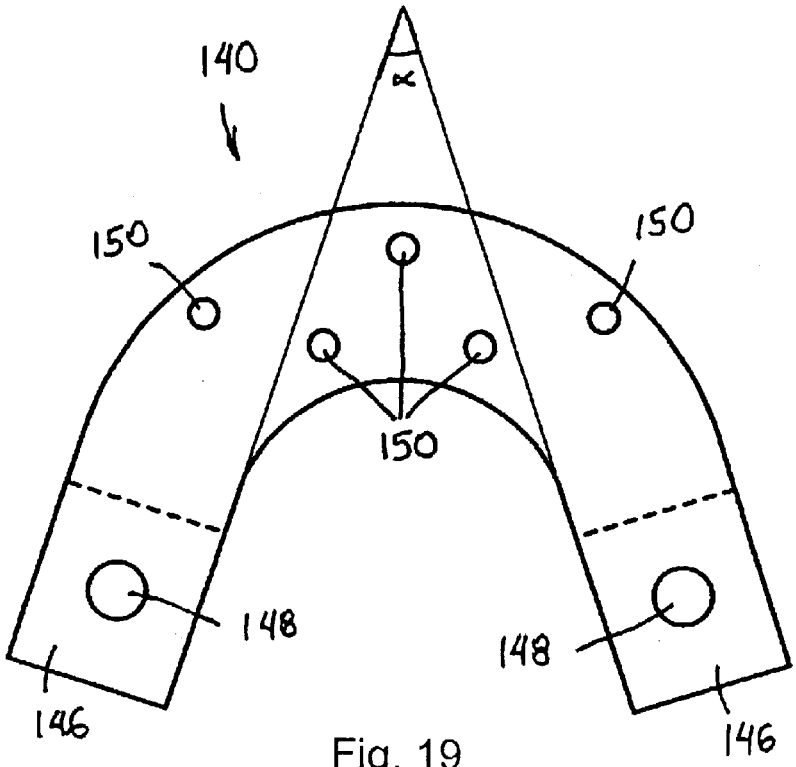
FIG. 19 is a front view of a fixed hinge mechanism for use with the convertible ladder.
Figure 21:
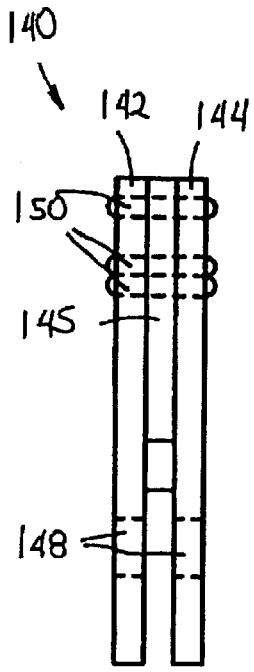
FIG. 21 is a side view of the fixed hinge mechanism.
Figure 20:
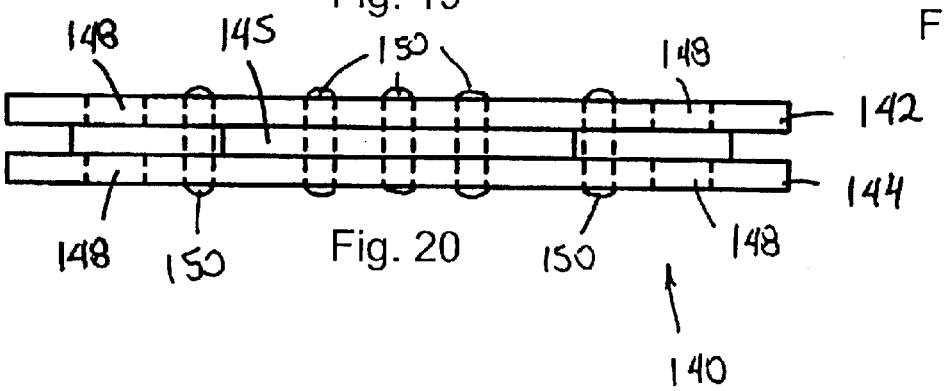
FIG. 20 is a top view of the fixed hinge mechanism.

The convertible ladder 10 also includes a fixed hinge mechanism 140 is most clearly illustrated in FIGS. 19–21. The fixed hinge mechanism 140 includes a first plate 142 and a second plate 144 that are attached together in a spaced-apart configuration.

The first plate 142 and the second plate 144 each preferably have a generally U-shaped configuration. An angle $\alpha$ between hinge legs 146 is less than 90 degrees, preferably between 20 and 50 degrees and most preferably about 35 degrees. A person of ordinary skill in the art will appreciate that the angle $\alpha$ is selected based upon the desired use conditions such as the weight that is to be placed on the second sections 32.

A length of the hinge legs 146 is selected so that the hinge legs 146 extend sufficiently into the second sections 32 to prevent the second sections 32 from rotating with respect to each other.

Proximate the end of the hinge legs 146, each of the hinge legs 146 has an aperture 148 formed therein. The aperture 148 is adapted to receive either the lock handle 53 to thereby retain the fixed hinge mechanism 140 in a fixed position with respect to the second sections 32.

Positioned between the first plate 142 and the second plate 144 is an intermediate plate 145. The intermediate plate 145 maintains the first plate 142 and the second plate 144 in a spaced apart relationship. The intermediate plate 145 also limits the extent to which the second sections 32 can be inserted into the fixed hinge mechanism 140.

The first plate 142, the second plate 144 and the intermediate plate 145 are attached to each other with a plurality of reinforcing members 150. The number and size of the reinforcing members 150 is selected based upon the anticipated load that is to be placed on the convertible ladder 10.

Figure 22:
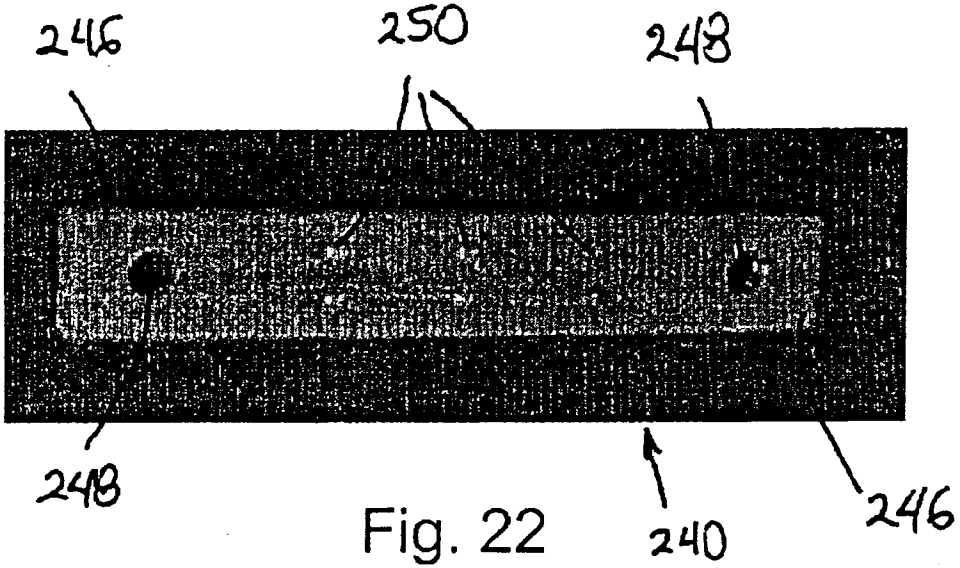
FIG. 22 is a side view of an alternative fixed hinge mechanism.
Figure 23:
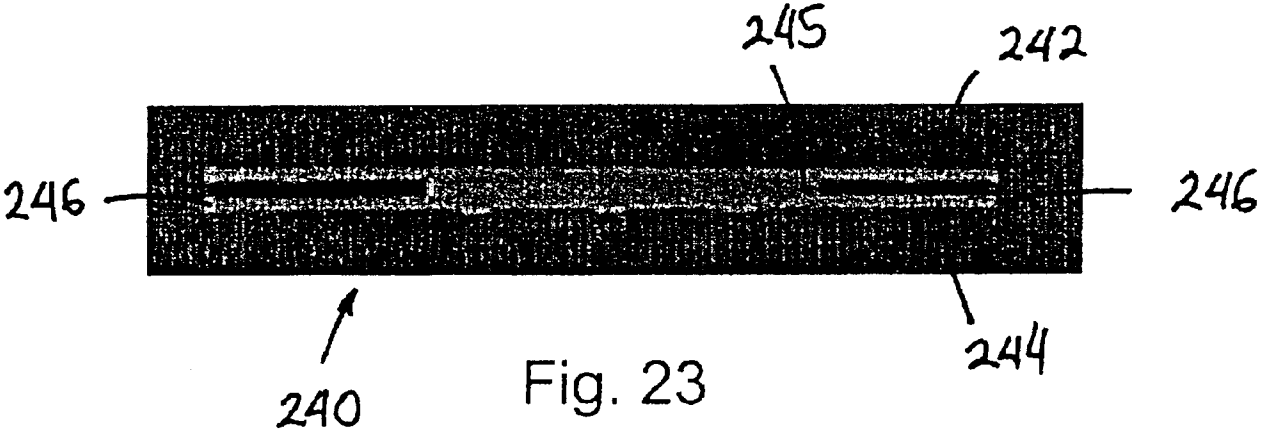
FIG. 23 is a top view of the alternative fixed hinge mechanism.

An alternative fixed hinge mechanism 240, which has a generally linear configuration, is illustrated in FIG. 22. The fixed hinge mechanism 240 enables second sections 32 to be attached to each other in a substantially aligned orientation.

The fixed hinge mechanism 240 includes a first plate 242, a second plate 244, and an intermediate plate 245. Proximate opposite ends of the fixed hinge mechanism 240 are hinge legs 246.

A length of hinge legs 246 is selected so that the hinge legs 246 extend sufficiently into the second sections 32 to prevent the second sections 32 from rotating with respect to each other.

Proximate the end of the hinge legs 246, each of the hinge legs 246 has an aperture 248 formed therein. The aperture 248 is adapted to receive either the lock handle 53 to thereby retain the fixed hinge mechanism 240 in a fixed position with respect to the second sections 32.

The intermediate plate 245 maintains the first plate 242 and the second plate 244 in a spaced apart relationship. The intermediate plate 245 also limits the extent to which the second sections 32 can be inserted into the fixed hinge mechanism 240.

The first plate 242, the second plate 244, and the intermediate plate 245 are attached to each other with a plurality of reinforcing members 250. The number and size of the reinforcing members 250 is selected based upon the anticipated load that is to be placed on the convertible ladder 10.

Figure 24:
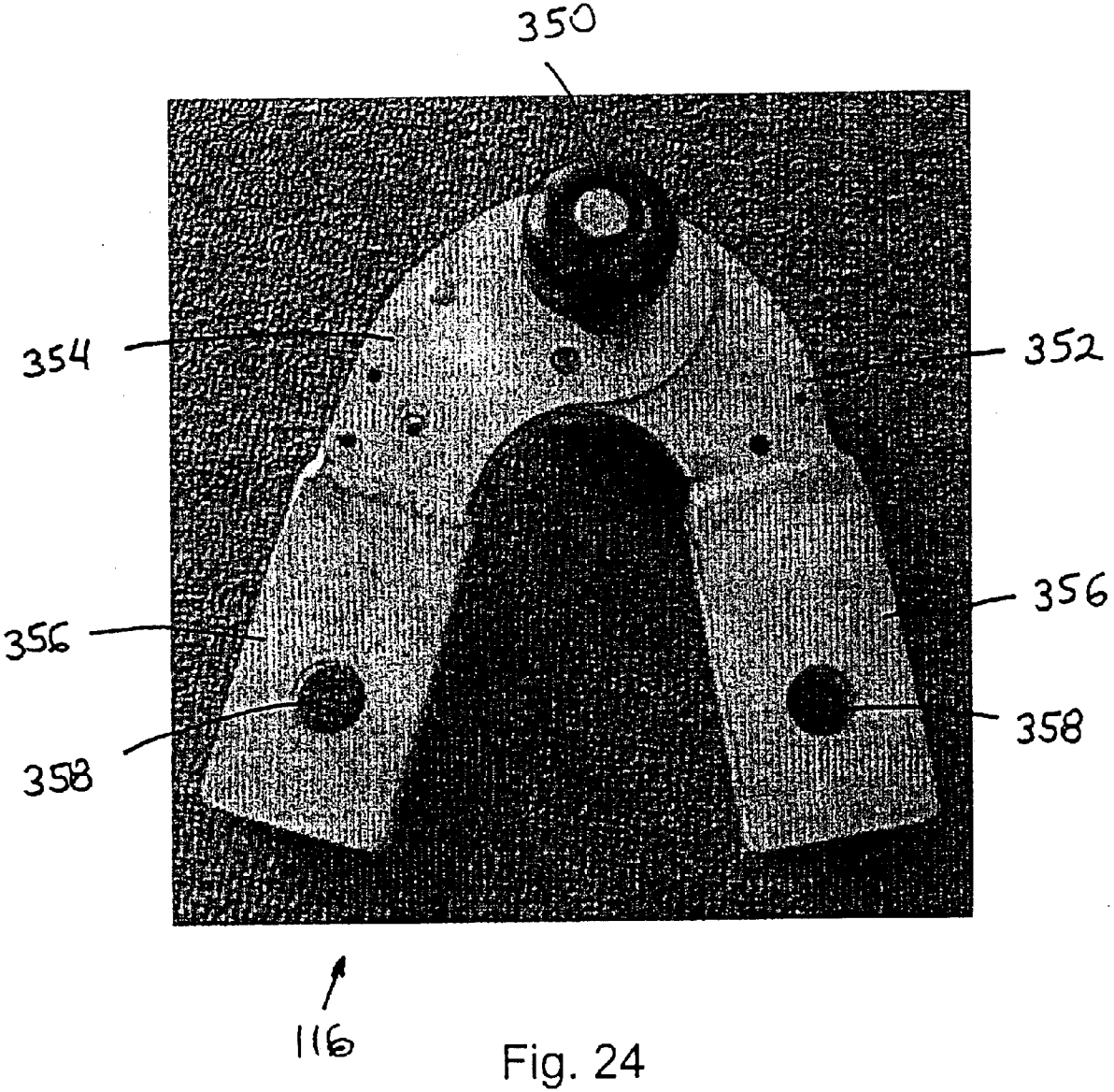
FIG. 24 is a top view of the alternative adjustable hinge mechanism in an assembled configuration.

The convertible ladder also includes an alternative adjustable hinge mechanism 116 for use with each portion of the second ladder section 32, as most clearly illustrated in FIG. 24. The adjustable hinge mechanism 116 enables the second sections 32 to be pivotally attached to each other.

The adjustable hinge mechanism 116 includes a handle 350, a first hinge plate 352, and a second hinge plate 354. The alternative hinge mechanism 116 also has two hinge legs 356. The first hinge plate 352 is pivotally mounted with respect to the second hinge plate 354.

Proximate the end of the alternative adjustable hinge legs 356, each of the hinge legs 356 has an aperture 358 formed therein. The aperture 358 is adapted to receive either lock handle 53 to thereby retain the alternative adjustable hinge mechanism 116 in a fixed position with respect to the second sections 32.

The configuration of the adjustable hinge mechanism 116 is preferably similar to the adjustable hinge mechanism 16. A difference between adjustable hinge mechanism 16 and the alternative hinge mechanism 116 is the ends of the hinge legs 356, which enables the adjustable hinge mechanism 116 to be removably attached to the second sections 32.

The components of the convertible ladder 10 are preferably fabricated from a lightweight aluminum material. However, a person of ordinary skill in the art will appreciate that it is possible to fabricate the convertible ladder 10 from alternate materials such as steel and fiberglass using the concepts of the present invention.

Figure 25:
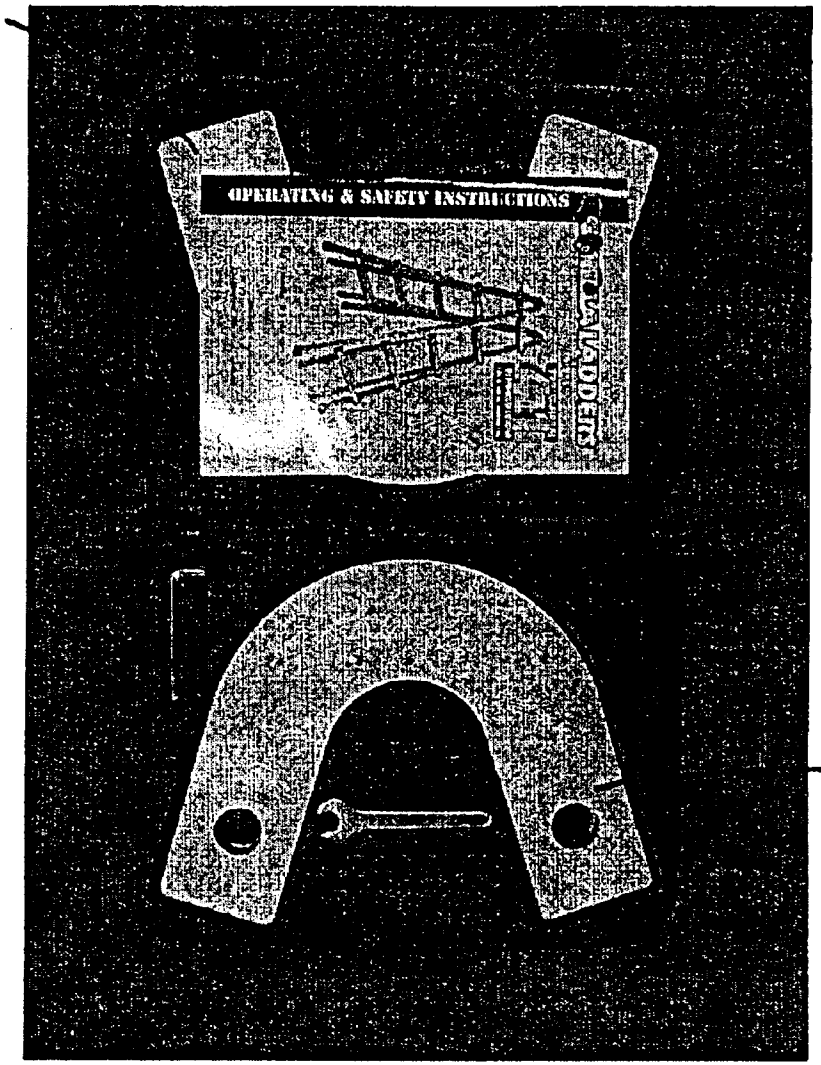
FIG. 25 is a photograph of a case for use with the convertible ladder.

Since the fixed hinge mechanism 140 is not used in three of the four configurations of the convertible ladder 10, there is the potential that the fixed hinge mechanism 140 will be misplaced when not in use. To minimize the potential of the fixed hinge mechanism 140 being lost, the fixed hinge mechanism 140 is preferably stored in a case 160. The case 160 is preferably injection molded plastic and includes a handle, as is illustrated in Fig. FIG. 25. The case may also be used to store other items such as instructions on the use of the convertible ladder 10.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A ladder comprising:

a first ladder portion having a first and second side rails and a first rung with an inner surface, and the first and second side rails each having an aperture that aligns with a respective inner surface;

a second ladder portion having a first and second side rails and a first rung with an inner surface, and the first and second side rails each having an aperture that aligns with a respective inner surface;

a first locking mechanism attached to the first rung of the first ladder portion;

a second locking mechanism attached to the first rung of the second ladder portion; and a pair of static hinge nonadjustable mechanisms, each said static hinge mechanism comprising a first plate, a second plate, an intermediate plate desposed between and spacing the first and second plates apart, and the first and second plates having a length greater that a length of the intermediate plate, wherein opposite ends of both the first and second plates extend beyond the intermediate plate to define a recess at both ends to form a pair of hinge legs with apertures therein, wherein a first of the pair of static hinge mechanisms is attached to the first ladder portion with the first locking mechanism, wherein a second of the pair of static hinge mechanisms is attached to the second ladder portion with the second locking mechanism, wherein the first and second locking mechanisms each having a first and second bar that aligns with the aperture in the first and second rails, respectively, the first and second bars extend through the apertures in the first and second side rails of the first and second ladder portions, through the apertures in the first and second static hinge mechanism, and into the inner surfaces of the first rungs of the first and second ladder portions, wherein the static hinge mechanism maintains the first ladder portion in a stationary relation with respect to the second ladder portion.

2. The ladder of claim 1, wherein the first and second static hinges are liner.

3. The ladder of claim 1, wherein each of the first and second ladder portions has a plurality of rungs.

4. The convertible ladder of claim 1, wherein the first and second locking mechanisms are biased to the engaged position.

5. The convertible ladder of claim 1, wherein the first and second side rails each have a C-shape with a main section and a pair of side sections that extend from the main section to define a recess therein, and wherein the recess is adapted to receive a portion of the static hinge mechanism.

* * * * *

UNITED STATES PATENT AND TRADEMARK OFFICE

CERTIFICATE OF CORRECTION

PATENT NO. : 6,857,503 B2
APPLICATION NO. : 10/360540
DATED : February 22, 2005
INVENTOR(S) : Simpson et al.

It is certified that error appears in the above-identified patent and that said Letters Patent is hereby corrected as shown below:

Title page, item 63, Line 2:

Delete "which" and insert --and--.

Signed and Sealed this

Eighteenth Day of December, 2007

JON W. DUDAS
*Director of the United States Patent and Trademark Office*